United States Patent [19]

Schulz

[11] 4,340,397

[45] Jul. 20, 1982

[54] SLAGGING GASIFIER

[75] Inventor: Helmut Schulz, Harrison, N.Y.

[73] Assignee: Brandenberg Energy Corporation, Harrison, N.Y.

[21] Appl. No.: 196,817

[22] Filed: Oct. 14, 1980

[51] Int. Cl.[3] ..... C10J 3/68

[52] U.S. Cl. ..... 48/74; 48/76; 48/77; 48/63

[58] Field of Search ..... 48/77, 74, 76, 62 R, 48/63, 64, DIG. 2

[56] References Cited

U.S. PATENT DOCUMENTS

| | | | |
|---|---|---|---|
| 1,938,139 | 12/1933 | Ekelund | 48/203 |
| 2,681,852 | 6/1954 | Atwell | 48/DIG. 4 |
| 4,073,627 | 2/1978 | Anderson | 48/62 R |
| 4,119,411 | 10/1978 | Anderson et al. | 48/77 X |
| 4,309,195 | 1/1982 | Rotter | 48/63 |

FOREIGN PATENT DOCUMENTS

| | | | |
|---|---|---|---|
| 906584 | 5/1945 | France | 48/76 |

OTHER PUBLICATIONS

Replenishment Processes and Flow Train Interaction, by D. B. Stickler et al., presented May 1976, 15th Symposium on Engineering Aspects of MHD, Univ. of Penn.

*Primary Examiner*—Arthur D. Kellogg
*Attorney, Agent, or Firm*—Lawrence Rosen

[57] ABSTRACT

A slagging gasifier for the gasification of coal and organic waste materials is disclosed The gasifier includes a vertical blast furnace having a hearth section at the bottom thereof. A slag tap hole is formed in hearth section and opens into a quenching vessel. A honeycomb structure is formed on the inner surface of said hearth section in the area surrounding said slag tap hole, and the inner wall of the hearth section. A plurality of tuyeres extend into the hearth section and feed the furnace with steam and oxygen so as to permit the oxidation of coal and organic waste materials fed into the furnace. As a result of the oxidation, gas and molten slag are formed in the furnace. The slag is collected in the hearth section and exits the hearth section via the tap hole. One or more conduits are provided for recycling (either internally or externally) the gas exiting the top of the gasifier with the tars, oils, and particulates entrained therein to the partial combustion zone of the gasifier where the tars, oils and particulates are converted to non-condensible gases. A portion of the tar-free product gas is removed from an intermediate point in the gasifier below the pyrolysis and coking zone.

18 Claims, 10 Drawing Figures

FIG. 6
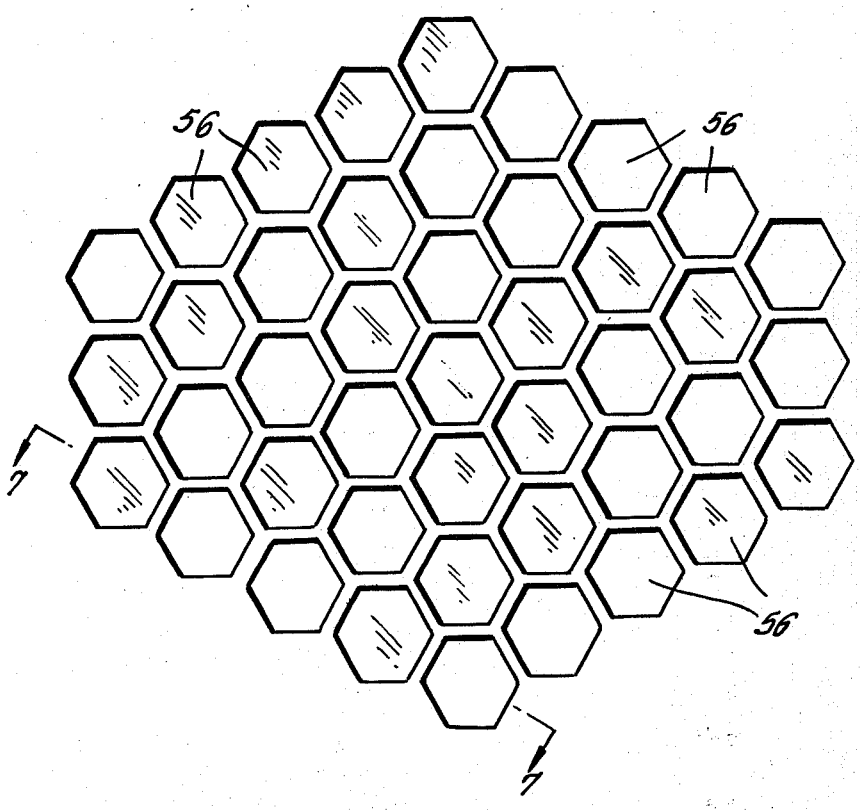
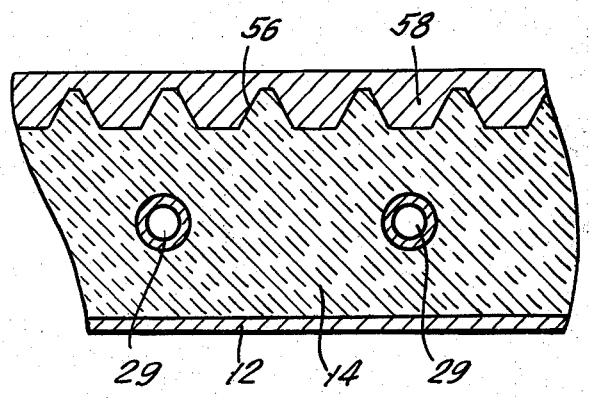
FIG. 7

FIG. 10
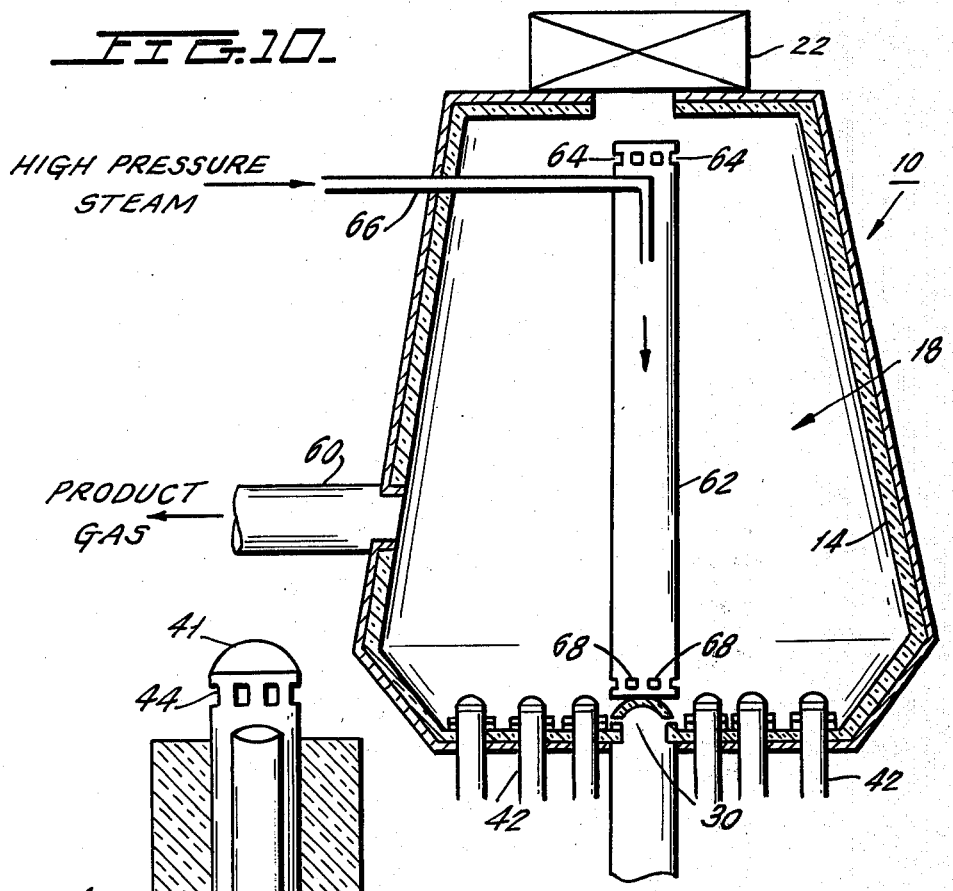
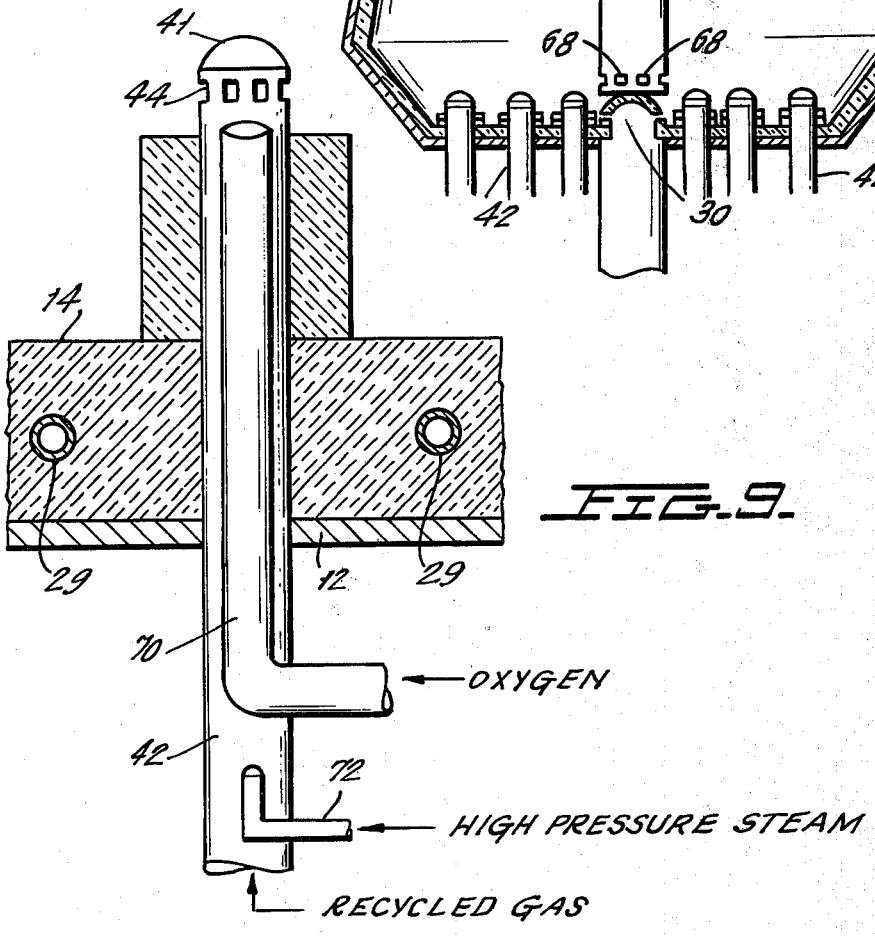
FIG. 9

SLAGGING GASIFIER

BACKGROUND OF THE INVENTION

The blast furnace has been in successful operation in the steel industry for over a century. Recently, the basic design of the blast furnace has been adapted for use in the gasification of coal, especially when operating with a "slagging bottom" in which the mineral components of the coal ash are removed from the gasifier in the form of a molten slag. Still more recently, a shaft furnace having blast furnace geometry has been adapted for the simultaneous pyrolysis and gasification of briquetted mixtures of coal and cellulosic waste materials such as municipal solid waste, dewatered sewage sludge, and sylvan waste or shredded pulpwood. See U.S. Pat. Nos. 4,052,173 4,152,119 and 4,225,457. The preparation of the burden in the form of sturdy briquettes has made it possible to employ gasifiers of much larger diameter than the 13-foot diameter coal gasifiers that have thus far been proposed. The slagging Lurgi gasifier operated by the British Gas Corporation in Westfield, Scotland is less than 7 feet in diameter.

One problem that has limited the use of larger and more economical gasifiers is the difficulty of securing even distribution of the oxidizing medium when employing tuyeres that enter the gasifier from its periphery either horizontally or slightly canted. It is an object of the present invention to overcome this limitation.

Another problem that is especially acute when processing briquetted mixtures of coal and municipal solid waste is corrosion and erosion of the refractory lining by a molten slag that is constantly changing in composition and fluxing characteristics because of the heterogeneous and ever-changing nature of the inorganic impurities introduced with municipal solid waste and sewage sludge. The slag has a tendency to penetrate, impair and erode the refractory lining in the high temperature hearth area of the gasifier. It has been accepted practice to attempt to shield the refractory lining against such attack by providing a temperature gradient that would cause frozen slag to deposit on the inner surface of the refractory lining. This theoretically logical solution has failed in practice because it was found that the congealed slag had a tendency to crack and flake off with the result that the refractory lining is intermittently exposed to molten slag with resultant impairment of the refractory.

The foregoing difficulty is overcome in the present invention by providing a honeycomb structure of open cells or recesses which serve to support the islands of congealed slag that are caused to form within the recesses by imposition of a controlled temperature gradient. The ceramic retaining walls of the cells prevent the propagation of cracks and effectively eliminate the spalling that has traditionally defeated the practical application of the otherwise sound principle of interposing a barrier of frozen slag between the refractory lining and the corrosive molten slag.

Another problem that has frequently interfered with the smooth operation of a slagging bottom gasifier is related to the continuous removal of molten slag from the bottom of the gasifier without seriously eroding the tap hole or plugging the opening with frozen slag. The hearth design of this invention effectively precludes these operating difficulties, while providing for the continuous removal of the slag into a quenching vessel from which the water quenched granules are removed through a lock hopper. This design permits continuous slag removal when operating the gasifier either at atmospheric or at elevated pressures.

The operation of moving burden gasifiers has normally resulted in the production of gas contaminated with tars, oils and particulates. One of the objectives of the present invention is to produce a product gas that is free of these undesirable constituents.

BRIEF DESCRIPTION OF THE INVENTION

In order to obtain the foregoing and other objects of the present invention, one embodiment of the slagging gasifier of the present invention comprises:

a vertical blast furnace including a hearth section at the bottom thereof;

a slag tap hole formed in said hearth section;

a geometric array of recesses formed on the inner surface of said hearth section;

means for oxidizing coal and organic waste material fed into said furnace such that gas and molten slag are formed in said furnace, said slag collecting in said hearth section and exiting via said tap hole;

cooling means associated with said hearth section for cooling said hearth section in a manner which causes the formation of a solid layer of slag anchored in said recesses on an inner surface of said hearth section.

A second embodiment of the slagging gasifier of the present invention comprises:

a vertical blast furnace including a hearth section at the bottom thereof;

a slag tap hole formed in said hearth section;

means for introducing a charge comprising coal or briquetted carbonaceous materials into said blast furnace near the top thereof such that said charge travels down said blast furnace towards said hearth section;

means for introducing oxidizing gases into said blast furnace near the bottom thereof such that oxidizing gases flow up said blast furnace as said charge travels down said blast furnace whereby gas and molten slag are formed in said furnace, said slag collecting in said hearth section and exiting via said tap hole;

means for removing tar-laden gases from said blast furnace near the top thereof and for recirculating said gases to the hearth section of said blast furnace; and means for removing tar free clean gases from said blast furnace near the bottom thereof.

In accordance with a preferred embodiment of the invention, the blast furnace includes an upwardly converging conical frustrum connected at its lower extreme to a downwardly converging conical frustrum and a hearth plate joined to the lower extreme of the downwardly converging frustrum. In such an embodiment, the hearth section is defined by the downwardly converging conical frustrum and the hearth plate. A concentric tap hole is formed in the hearth plate and is connected to a vertical quenching vessel which receives slag exiting the furnace. A honeycomb structure of open cells or recesses is formed on the inner surface of said hearth section. A metallic annulus is imbedded in the perimeter of the tap hole and is provided with cooling means for cooling the annulus in a manner which causes the controlled formation of a solid layer of slag around the inner surface of the tap hole. The cooling means is operated in a manner which causes the formation of a dam around the edge of said tap hole. The height of the dam is sufficiently low to permit slag formed in the furnace to overflow the dam and exit the furnace through the tap hole. In order to prevent clogging of the tap hole as a result of the formation of solid slag in the tap hole, a plurality of torches surround the tap hole and can selectively expose the tap hole to a flame. The tap hole is surmounted by a ceramic dome which deflects the burden from exiting with the slag while permitting slag to flow into the tap hole through vertical slots in the lower perimeter of the dome.

The quenching vessel receiving the slag exiting the furnace is filled with water to a predetermined height and causes the formation of fritted slag. The fritted slag is intermittently removed from the quenching vessel via a lock hopper. In the preferred embodiment, the slagging gasifier includes water-cooled fins located in the quenching vessel to cool the water in the vessel. The quenching vessel further includes means for condensing and refluxing steam formed in the quenching vessel as a result of the quenching process. It is to be understood, however, that the shaft furnace may also be cylindrical in configuration, especially if of large diameter.

In a preferred embodiment, the oxidizing gas is introduced by means of a plurality of vertical tuyeres extending through the hearth plate into the blast furnace. The tuyeres end in a solid plug and have a plurality of radial holes evenly spaced around the periphery of the tuyere just below the plug. The location and orientation of the radial holes are such that the mixture of steam and oxygen flowing through the tuyeres is horizontally injected into the furnace. A capped ceramic sleeve covers the tuyeres to protect them from the molten slag.

In a preferred embodiment, the present invention includes a slagging, moving burden gasifier of blast furnace configuration for the conversion of coal or carbonaceous materials to a clean fuel or synthetic gas. Conversion is achieved as the burden undergoes a series of controlled chemical reactions as it descends through the blast furnace past four descending temperature zones: a Drying and Preheat zone, a Pyrolysis and Coking zone, a High Temperature Reaction zone and a Partial Combustion zone. The burden, which may be a briquetted blend of carbonaceous materials, is fed into the top of the gasifier through one or more lock hoppers. Oxygen and steam are introduced to the hearth through vertical tuyeres. Means are provided for recycling tar-laden gases and entrained particulates from the top of the gasifier to the Partial Combustion zone. This means may comprise either an internal downcomer or one or more heated external conduits. The oils, tars and particulates are recycled and consumed in the Partial Combustion zone with a result that a tar-free product gas may be withdrawn just below the Pyrolysis and Coking zone. Steam jets provide the driving force to draw gases in entrained oils, tars and particulates from the top of the gasifier through the downcomer or external conduit so as to inject them into the Partial Combustion Zone.

BRIEF DESCRIPTION OF THE DRAWINGS

For the purpose of illustrating the invention, there is shown in the drawings an embodiment which is presently preferred, it being understood, however, that the invention is not limited to the precise arrangements and instrumentalities shown.

FIG. 6 is a detailed view illustrating an array of honeycomb cells formed on the inner surface of the hearth section of the blast furnace.

FIG. 7 is a sectional view of the array of honeycomb cells taken along lines 7—7 of FIG. 6.

FIG. 9 is a detailed view of a portion of the recirculating system of the embodiment of FIG. 8.

FIG. 10 is a side view, partially in section, illustrating a third embodiment of the present invention wherein tar-laden gases are internally recirculated to the Partial Combustion zone of the gasifier.

DETAILED DESCRIPTION OF THE PREFERRED EMBODIMENT

Figure 1:
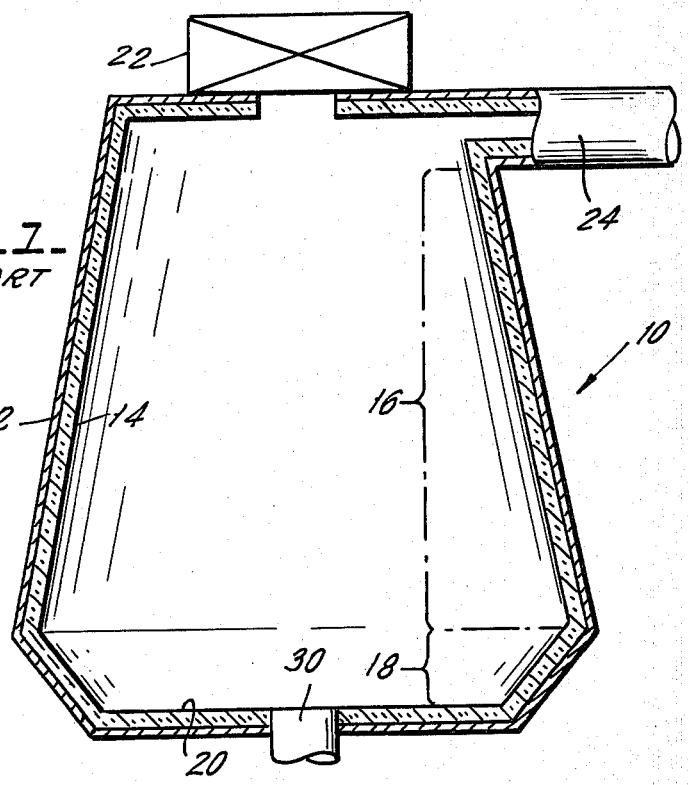
FIG. 1. PRIOR ART
FIG. 1 is a view, partially in section, of a prior art blast furnace which may be used in connection with the present invention.

For the purpose of disclosing the novel and useful features of the invention, it is assumed that the gasifier is of the conventional type comprising a blast furnace as shown in FIG. 1. The furnace 10 comprises a water-cooled steel shell 12 lined, at least in part, with a refractory ceramic material 14. The furnace 10 normally includes a conical frustrum 16 converging upwardly and joined at its bottom to a shorter conical frustrum 18 converging downwardly to terminate in a horizontal hearth plate 20. Coal or other carbonaceous material is introduced to the top of the blast furnace 10 through a charging lock 22 or other suitable feed mechanism, such as a ram or screw feeder. The gas produced by the furnace 10 is withdrawn from the furnace through conduit means 24, and is conducted to a gas clean-up train comprising components which are well known in the art.

Figure 8:
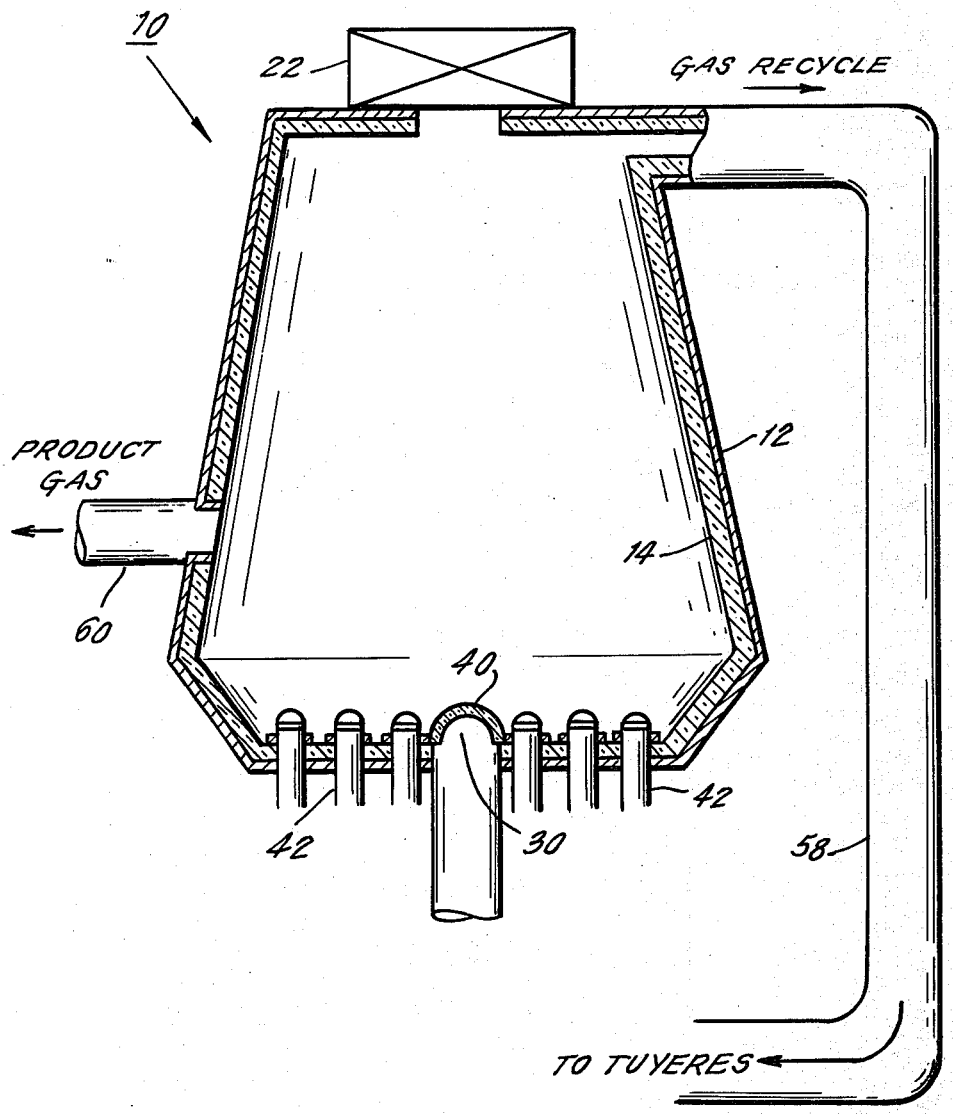
FIG. 8 is a side view, partially in section, of a gasifier constructed in accordance with a second embodiment of the present invention wherein tar-laden gases are externally recirculated to the Partial Combustion zone of the gasifier.

Alternately, the novel gas recycling provision of this invention may be employed by providing internal or external conduits as illustrated in FIGS. 8–10 and described below.

The present invention is an improvement in the design of slagging gasifiers which is concerned partly with the design and construction of the high-temperature hearth section, including the introduction of oxidizing agent into the gasifier, and the continuous withdrawal of molten slag into a quenching receiver. The innovative features of the present invention will now be described with reference to FIGS. 2–5.

Figures 2, 3:
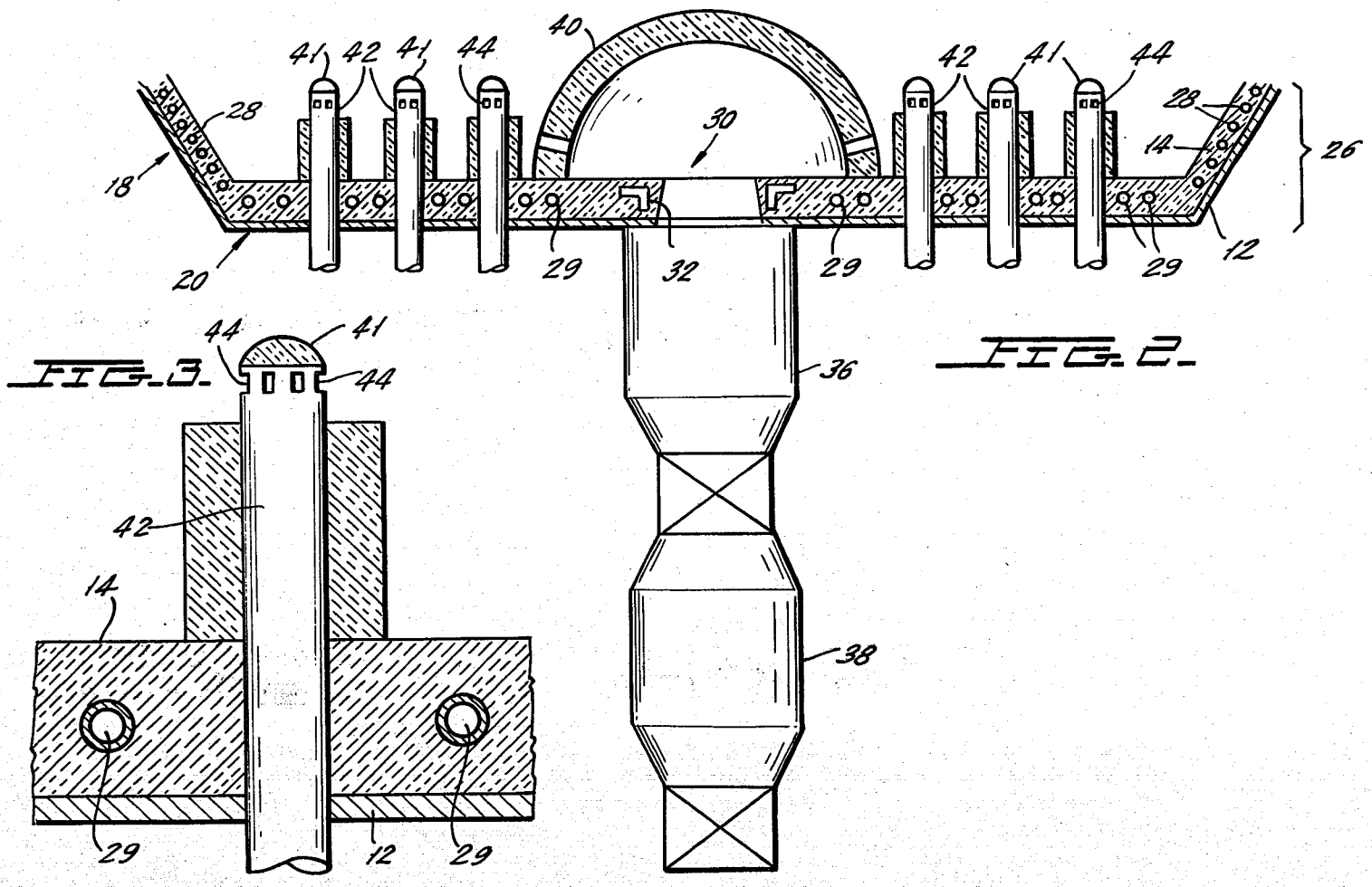
FIG. 2 is a side view, partially in section, illustrating the manner in which the hearth section of the blast furnace of FIG. 1 may be modified to cause the blast furnace to operate as a gasifier in accordance with a first embodiment of the present invention.
FIG. 3 is a detailed view, partially in section, of one of the tuyeres illustrated in FIG. 2.

As shown in FIG. 2, the lower downward converging conical frustrum 18 and the horizontal refractory hearth plate 20 of the furnace 10 define a hearth section 26 in which molten slag is collected. Cooling means 28 are formed in the refractory lining 14 of conical frustrum 16 and cooperate with cooling means 29 located in the refractory lining 14 of hearth plate 20 to circulate cooling fluid through hearth section 26 in a controlled manner described in greater detail below. A concentric circular tap hole 30 is formed in the hearth plate 20 and is bounded by an L-shaped metallic annulus 32 having cooling medium 34 (FIG. 4) circulated therein. A cylindrical quenching vessel 36 is joined to the steel shell 12 of shaft furnace 10 and leads to a conical lock hopper 38 joined to the bottom of the cylindrical quenching vessel 36. A refractory dome-shaped deflector cap 40 surmounts the tap hole 30 and is slotted at its lower perimeter to permit the free flow of molten slag into the tap hole 30. An array of vertical tuyeres 42 penetrate the horizontal hearth plate 20 and are positioned to ensure uniform distribution of oxidant gas and steam throughout the Partial Combustion zone (located in the hearth area) of the gasifier. The tuyeres 42 are preferably capped at their upper extremity. As best viewed in FIG. 3, each tuyere 42 has a number of radial holes 44 evenly spaced around its circumference at a level just below the cap so as to cause the mixture of steam and oxidizing gas applied to the tuyeres from a source (not shown) located below the hearth plate 20 to be horizontally injected into the gasifier bed. The portion of the metal tuyeres 42 which extends into gasifier 10 is protected by a capped ceramic sleeve 46 which has radical holes in line with the radial holes 44 in each tuyere 42. The number and geometric disposition of the tuyeres 42 is determined by the diameter of the gasifier 10. The location of tuyeres 42 should provide for the uniform distribution of oxidizing gas throughout the hearth area.

During operation, the oxidizing gas (e.g., a mixture of oxygen and steam) is introduced into hearth section 26 under pressure via tuyeres 42, flowing upwardly in each tuyere until the flow is deflected outwardly through the radial holes 44 in the tuyeres 42. The holes 44 are located a sufficient distance above the floor of hearth plate 20 so that the gases enter the chamber above the slag layer. The bed of gravitating coke and char is supported in part by the dome-shaped caps 41 of sleeves 42, and in part by the horizontal hearth plate 20, reacting with the stream of oxidizing gas until consumed.

During operation, the cooling means 28, 29 and 34 are separately controlled to impose a temperature gradient inwardly through the refractory lining 14 so that the temperature of the inner wall of the lining is sufficiently below the melting point of the slag to insure the existence of a frozen layer of slag on the inner wall of refractory lining 14. This layer of slag preferably covers the entire inner surface of the hearth plate 20 and the frustrum 18. The cooling means 28 and 29 may each be in the form of stainless steel tubing through which a coolant, such as saturated steam at a controlled pressure, is circulated at a controlled rate to achieve the desired temperature gradient. The temperature gradient is determined by means of high-temperature thermocouples 48 (such as Pt-Pt/Rh) imbedded in the refractory lining 14 at appropriate locations. It is preferable to arrange the cooling coils as two or more separate banks in order to permit control of the degree of cooling imposed as the higher temperatures at the tuyere level are approached. The cooling means 29 in the hearth plate 20 may be in the form of stainless steel tubing through which the coolant is circulated and controlled to maintain a layer of frozen slag on the horizontal surface of sufficient thickness to protect the ceramic against corrosive and erosive attack.

Figure 4:
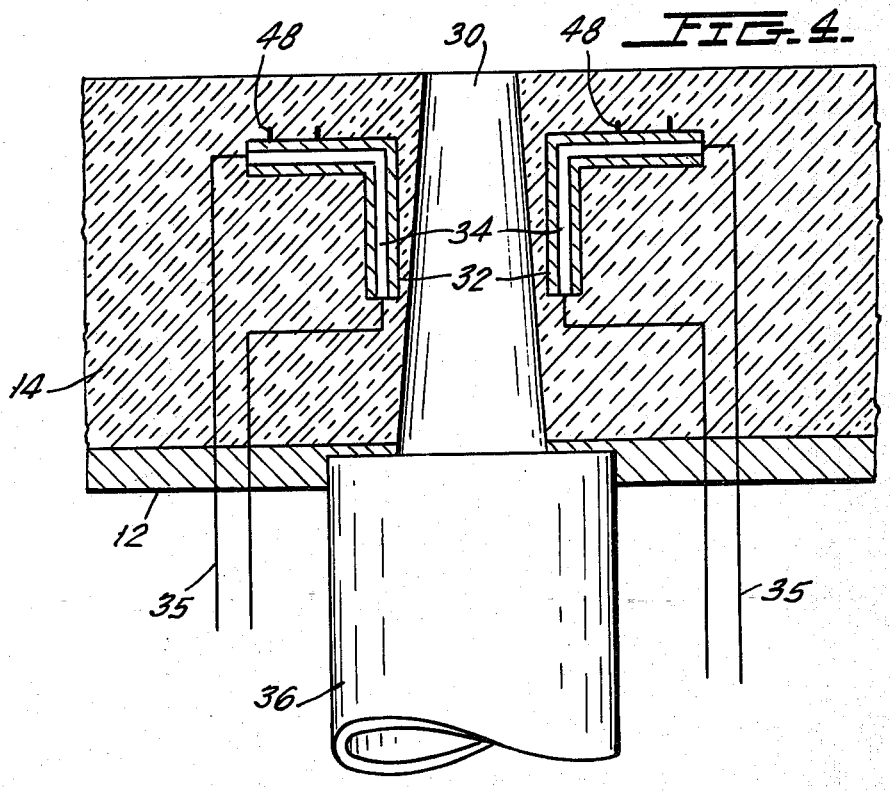
FIG. 4 is a detailed sectional view of the tap hole formed in the blast furnace of FIG. 2.

As best shown in FIG. 4, the cooling means 34 may be formed integrally with annulus 32 by forming annulus 32 as an L-shaped hollow channel through which cooling water may be circulated via supply conduit 35 to form a protective layer of congealed slag on its outer surface. The cooling water supply is automatically shut off in the event that there is a loss of coolant pressure. The temperature of the coolant water is regulated to maintain the desired thickness of frozen slag. Thermocouples 48 are attached to the outer surface of annulus 32 as shown in FIG. 4 as a means of controlling the flow and temperature of the coolant water.

Figure 5:
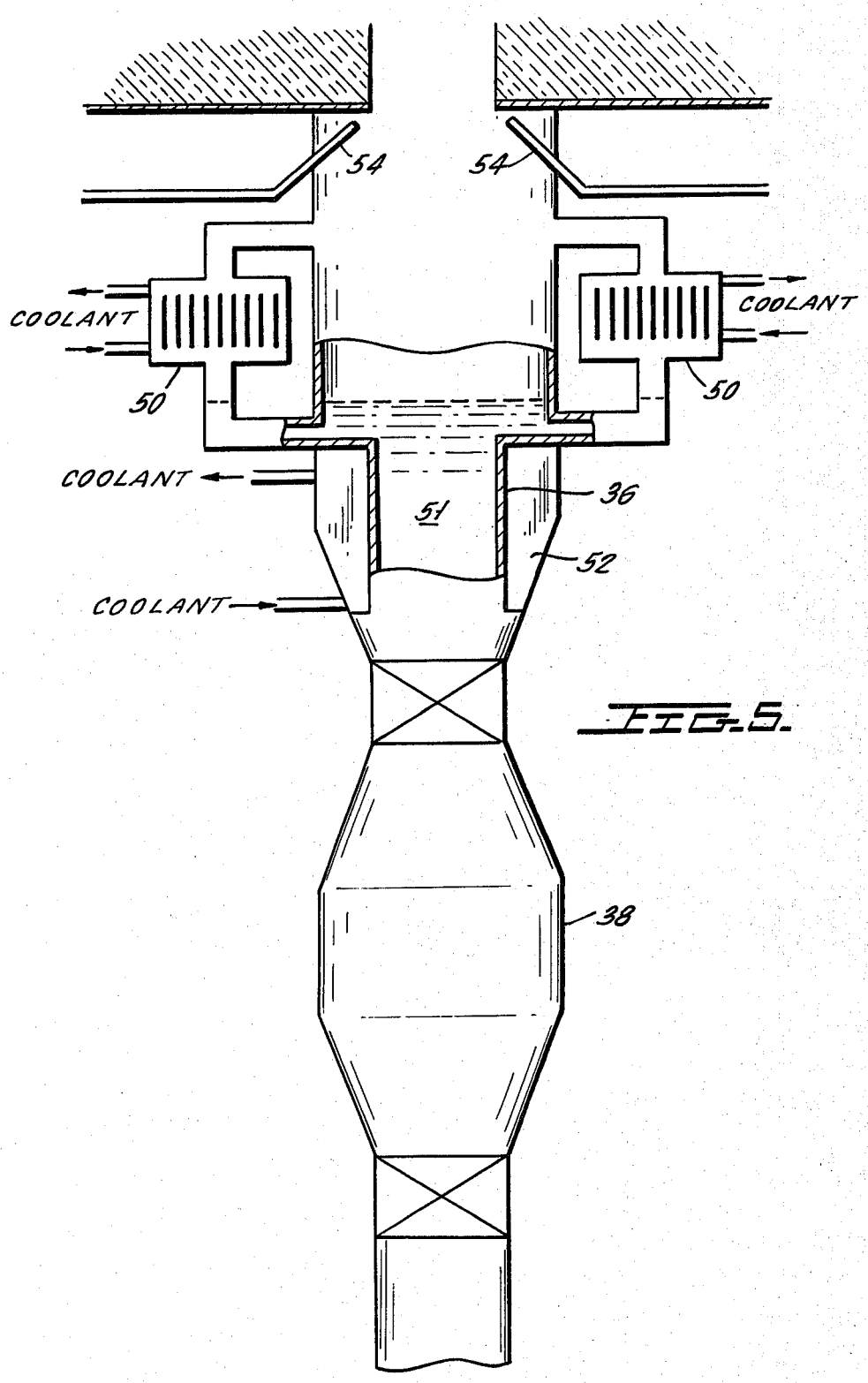
FIG. 5 is a detailed view, partially in section, of the quenching vessel illustrated in FIG. 2.

As shown in FIG. 5, the slag-receiving quench vessel 36 is cylindrical and is fitted with a conical bottom which feeds into a lock hopper 38. Lock hopper 38 is operated intermittently to remove fritted slag from the bottom of the quench vessel 36. Appropriate pressure equalization is provided between the two chambers (not shown) of lock hopper 38 in the customary manner.

The quench vessel 36 may be fitted with one or more condensors 50 which communicate with the vapor space of quench vessel 36 and provide a heat sink for the condensation of steam that may be generated in the quenching process, thereby minimizing the quantity of steam that enters the hearth section 26 through the tap hole 30. The quench water 51 (which is maintained at a predetermined height in vessel 36) is cooled to minimize boiling by providing a number of vertically disposed radial fins 52. These fins are water-cooled by means of internal water circulation channels, but are so disposed as not to interfere with the free fall of fritted slag. The surface area of fins 52 and the coolant flow through them are calculated to abstract both the latent heat of fusion of the slag under normal operation and the sensible heat to cool the frozen slag to the ambient temperature of the quench water.

In addition to the above design features, quench vessel 36 is provided with two or four opposed gas torches 54 which are mounted so that their flame fronts intersect the tap hole 30. The purpose of gas torches 54, which may burn methane or the product gas produced by gasifier 10 with oxygen as the oxidizing medium, is twofold. They may be employed to melt slag that has undesirably constricted the tap hole 30, and they may serve to start up gasifier 10 at the inception of any operating period. Torches 54 are preferably designed to accommodate an optical viewport (not shown) which permits visual observation of the critical tap hole area and the thickness of the frozen slag dams.

During start-up, torches 54 are operated until the carbonaceous burden on the hearth surrounding tap hole 30 has been heated to well above the ignition temperature. This condition is observed by means of optical fibers in one or more of the vertical tuyeres 42 comprising the innermost circle of tuyeres. Thereupon, oxygen is slowly admitted to the gasifier 10 through said inner circle of tuyeres 42 until ignition is observed. Next, full oxygen flow is established in the inner row of tuyeres 42. The start-up sequence is completed by bringing the outer circles of tuyeres 42 on stream in a similar manner, proceeding radially outward until all of the tuyeres have been observed to sustain combustion. Thereupon the steam flow is brought on line so as to control the hearth temperature at the desired level (e.g., 2900° F.). The starting torches 54 are kept in operation until the overflow of molten slag into the quench vessel 36 has been established. Thereupon they are extinguished to be reignited, if needed, for slag-flow control as discussed above.

A major feature of the present invention is the formation of a geometric array of honeycomb cells 56 (see FIGS. 6 and 7) which are formed on the inner surface of the refractory lining 14 of the hearth plate 20. The cells may be formed either by fabricating the fire bricks or ceramic blocks forming the refractory lining 14 with an appropriate array of recesses or by employing a castable ceramic material to form the refractory lining and impressing the desired cellular structure while the lining material is still in a plastic state. While a hexagonal pattern is preferred, other patterns could also be used as long as the geometric array of honeycomb cells or dimpled recesses 56 serve to partially encapsulate the deposits of molten slag 58 (not shown in FIG. 6) on the hearth plate 20 and thereby effectively eliminate the cracking and flaking of the frozen slag as has been the case with the prior art structures.

As the coal or organic waste materials travel down furnace 10 (after exiting hopper 22), they are coked or pyrolized in the Pyrolysis and Coking zone by contact with the hot ascending gases and the resulting coke and char gravitate to the Partial Combustion zone where they react with oxidizing gases entering the bottom of furnace 10 via tuyeres 42. As a result of this process, gas and molten slag are formed in furnace 10. In the embodiment of the invention described above, the gases formed as a result of this process are removed from the top of the furnace 10 via a conduit 24 (see FIG. 1) and are delivered to a conventional gas clean-up train which removes tar, oils, particulates, ammonia, hydrogen sulfide and other contaminants from the gas. The resultant clean gas may then be used as an energy source.

In accordance with the embodiment of the invention illustrated in FIGS. 8–9, the tar-laden gas reaching the top of furnace 10 is recirculated in a manner which makes it possible to withdraw relatively tar-free product gas from a lower portion of furnace 10. Before describing specific apparatus for carrying out this desired result, it is helpful to understand the processes taking place within the furnace 10. As is well known by those skilled in the art, a slagging, moving burden gasifier of blast furnace configuration includes in upward progression, the following zones located within the blast furnace 10: (1) a Partial Combustion zone, (2) a High Temperature Reaction zone, (3) a Pyrolysis and Coking zone, and (4) a Drying and Preheat zone. The Partial Combustion zone is located in the hearth area of the furnace 10 while the Drying and Preheat zone is located in the upper half of furnace 10. As the coal and other organic waste materials travel down through the furnace 10, they undergo various chemical reactions. As a result of these reactions, the gas generated at the bottom of the furnace 10 (in the Partial Combustion zone) is free of tar (having not yet interacted with the coal or other carbonaceous feed materials in the Pyrolysis and Coking zone). The gases reaching the top of the furnace 10 (above the Drying and Preheat zone) carry entrained tars, oils and particulates produced in the Pyrolysis and Coking zone (which zone normally has a temperature range of 600°–1600° F.). In the embodiment of the present invention illustrated in FIGS. 8 and 9, tar-laden gases are recirculated from the top of the position to the Partial Combustion zone where tars, oils and particulates entrained in the gas are subjected to thermal cracking and reaction with oxygen and steam and are converted to non-condensible, combustible gases comprising chiefly carbon monoxide, hydrogen and some carbon dioxide. The resulting tar and oil-free product gas is then removed from the furnace 10 via product gas conduit 60. The withdrawal of the product gas at a point below the Pyrolysis and Coking zone via conduit 60 is regulated to maintain the gasifier at the desired operating pressure level.

As a result of the foregoing, the gases generated in the Partial Combustion zone located at the bottom of furnace 10 are effectively split into two streams: a portion of the ascending gases being withdrawn from the gasifier just below the Pyrolysis and Coking zone as tar-free product gas, and the remaining gases continuing to ascend through the gravitating burden to provide the thermal driving force for the pyrolysis of the burden in the Pyrolysis and Coking zone and for drying and preheating the burden in the Drying and Preheat zone of the furnace 10. The gases leaving the top of furnace 10, carrying entrained tars, oils, etc., are recycled to the Partial Combustion zone as described above. Circulation of this gas stream is effectuated by means of jets of high pressure steam as described below.

Referring now to FIG. 8, the tar-laden gases are recirculated from the top of furnace 10 to the bottom thereof via one or more external heated conduits 58. The lower end of the conduit 58 is connected to one or more tuyeres 42 in the manner illustrated in FIG. 9. As shown in FIG. 9, the recycled gas leaving conduit 58 is circulated through tuyere 42 into the hearth section 18 of furnace 10. Oxygen is supplied to the hearth section 18 via a pipe 70 feeding tuyere 42. Superheated steam is supplied to tuyere 42 via a conduit 72 so as to aspirate the recycled gas from the top of furnace 10 through the external conduits 58 to the tuyeres 42. Alternatively, a steam jet may be located within the external conduits 58 for the same purpose.

Yet another embodiment of applicant's invention which also circulates the tar-laden gases through furnace 10 is illustrated in FIG. 10. In this embodiment, the external conduit 58 is replaced by an internal downcomer 62 located concentrically within furnace 10. A plurality of intake openings 64 are located near the top of downcomer 62 and enable tar-laden gases to enter the conduit 62 from the top of the furnace 10. These gases are carried to the lower end of conduit 62 by injecting superheated steam through steam jets 66 feeding into downcomer 62. The gases and steam traveling down conduit 62 exit at the bottom of conduit 62 via a plurality of openings 68 located in the hearth section of furnace 10. As in the embodiment of FIGS. 8 and 9, the tars, oils and particulates entrained in the gas flowing through conduit 62 are subject to thermal cracking and reaction with oxygen and steam in the Partial Combustion zone of the gasifier and are converted to non-condensible, combustible gases comprising chiefly carbon monoxide, hydrogen and some carbon dioxide. The relatively clean gases are removed from the furnace 10 via product gas conduit 60. The withdrawal of product gas from below the Pyrolysis and zone via conduit 60 is regulated to maintain the gasifier at the desired operating pressure level.

In the embodiments of FIGS. 8 and 10, a geometric array of recesses 56 is preferably formed on the inner surface of the hearth to anchor a protective layer of congealed slag as previously described with reference to FIG. 6.

The above description in conjunction with the detailed drawings provided fully discloses the principles and a specific embodiment of the novel apparatus design which will afford a significant improvement in the construction and operation of a slagging gasifier. It is to be understood that numerous design variations are possible without departing from the principles of this invention.

What is claimed is:

1. A slagging gasifier for the gasification of coal or carbonaceous materials comprising:

a vertical blast furnace including a hearth section at the bottom thereof;

a slag tap hole formed in said hearth section;

means for introducing a charge comprising coal or briquetted carbonaceous materials into said blast furnace near the top thereof such that said charge travels down said blast furnace towards said hearth section;

means for introducing oxidizing gases into said blast furnace near the bottom thereof such that said oxidizing gases flow up said blast furnace as said charge travels down said blast furnace whereby gas and molten slag are formed in said furnace, said slag collecting in said hearth section and exiting via said tap hole;

a first gas removing means comprising a vertically extending conduit located inside said blast furnace and having a first opening near the top of said furnace and a second opening near the bottom of said furnace; and means for causing steam to flow through said conduit in a direction from said first to said second opening; and a second gas removing means for removing relatively tar-free gases from said blast furnace in the lower portion thereof.

2. A slagging gasifier as in claim 1 wherein a Pyrolysis and Coking zone is defined in said furnace and wherein said first gas removing means is above said zone and said second gas removing means is below said zone.

3. The slagging gasifier of claim 1 or claim 2 wherein said vertically extending conduit comprises a cylindrical tube concentrically located within said blast furnace and having a first opening near the top of said furnace and a second opening near the bottom of said furnace and steam jets within said tube causing steam to flow through said tube in a direction from said first to said second opening;

and wherein said blast furnace has the geometric configuration of a cylinder or a downwardly diverging conical frustrum.

4. The slagging gasifier of claim 3, further including:

a geometric array of recesses formed on the inner surface of said hearth section; and cooling means associated with said hearth section for cooling said hearth section in a manner which causes the formation of a solid layer of slag on said geometric array of recesses.

5. The slagging gasifier as in claim 1 wherein said tap hole is in the form of a concentric circular opening.

6. A slagging gasifier for the gasification of coal and carbonaceous materials comprising:

a vertical blast furnace including a hearth section at the bottom thereof;

a slag tap hole formed in said hearth section;

a geometric array of recesses formed on the inner surface of said hearth section;

cooling means associated with said hearth section for cooling said hearth section in a manner which causes the formation of a solid layer of slag anchored in said recesses on said geometric array of recesses, and wherein said oxidizing means include means for introducing a mixture of steam and oxygen into said furnace, said introducing means comprising a plurality of tuyeres extending vertically into said hearth section, wherein each of said tuyeres ends in a solid plug and has a plurality of radial holes evenly spaced around the periphery of said tuyeres just below said plug and so oriented that said steam and oxygen are horizontally injected into said furnace; and means for oxidizing coal and carbonaceous materials fed into said furnace such that gas and molten slag are formed in said furnace and exit said furnace via conduit means connected to said furnace; said slag collecting in said hearth section and exiting via said tap hole.

7. The slagging gasifier of claim 6, further comprising a respective capped ceramic sleeve covering each of said tuyeres.

8. The slagging gasifier of claim 7, wherein said tuyeres are spaced in a manner which will cause said steam and oxygen to be evenly distributed through said hearth section.

9. A slagging gasifier as in claim 6, further comprising an annulus surrounding said tap hole and second cooling means for cooling said annulus in a manner which causes the formation of a solid layer of slag around the inner surface of said tap hole.

10. The slagging gasifier of claim 9, wherein one or more gas burning torches are mounted below the slag hole to expose said tap hole to a flame.

11. The slagging gasifier of claim 6 wherein said cooling means cause the formation of a solid layer of slag on the entire inner surface of said hearth plate.

12. The slagging gasifier of claim 6, wherein said annulus is hollow and said second cooling means comprise means for circulating cooling fluid through said annulus.

13. The slagging gasifier of claim 6, 7 or 8 wherein said cooling means comprise metal tubes embedded in said refractory lining in the area of said hearth section including the substantially horizontal hearth plate which is penetrated by said vertical tuyeres.

14. The slagging gasifier of claim 6, further comprising a vertical quenching vessel coupled to the bottom of said blast furnace and adapted to receive slag exiting said furnace via said tap hole, and water-cooled fins located in said quenching vessel to cool water located in said vessel.

15. The slagging gasifier of claim 14, wherein steam is generated in said quenching vessel and wherein said quenching vessel communicates with means for condensing said steam.

16. The slagging gasifier of claim 14, wherein fritted slag is formed in said quenching vessel and wherein said quenching vessel further includes means for intermittently discharging said fritted slag from said quenching vessel.

17. The slagging gasifier of claim 6 wherein said geometric array of recesses is formed on said hearth plate surrounding said tap hole and tuyeres.

18. The slagging gasifier of claim 6 wherein said geometric array comprises an array of honeycomb cells.

* * * * *